US006011224A

United States Patent [19]

Zdanys, Jr.

[11] Patent Number: 6,011,224

[45] Date of Patent: Jan. 4, 2000

[54] DIP SWITCH WITH WIRE CONTACTS

[75] Inventor: John Zdanys, Jr., Elkhart, Ind.

[73] Assignee: CTS Corporation, Elkhart, Ind.

[21] Appl. No.: 09/183,213

[22] Filed: Oct. 30, 1998

[51] Int. Cl.[7] ..... H01H 15/02

[52] U.S. Cl. ..... 200/16 D; 200/291; 200/550

[58] Field of Search ..... 200/16 C, 16 D, 200/16 R, 16 F, 291, 547–550, 292

[56] References Cited

U.S. PATENT DOCUMENTS

| | | | |
|---|---|---|---|
| 3,555,213 | 1/1971 | Cherry | 200/17 R |
| 4,012,608 | 3/1977 | Lockard | 200/16 D |
| 4,168,404 | 9/1979 | Lockard | 200/1 R |
| 4,268,728 | 5/1981 | Rose | 200/16 R |
| 4,324,958 | 4/1982 | Valleau | 200/16 F |
| 4,389,549 | 6/1983 | Brown | 200/5 R |
| 4,427,851 | 1/1984 | Schwab | 200/16 D |
| 4,529,851 | 7/1985 | Priebe et al. | 200/16 D |
| 4,590,344 | 5/1986 | Kikta et al. | 200/291 |
| 4,737,602 | 4/1988 | Yamamoto | 200/16 D |

FOREIGN PATENT DOCUMENTS 0 003 434 A1 4/1979 European Pat. Off. .

*Primary Examiner*—J. R. Scott
*Attorney, Agent, or Firm*—Mark P. Bourgeois

[57] ABSTRACT

A dual in line switch apparatus selects between several switch positions. Specifically there is a housing that contains slides. The slides have a slide groove on each end and a slide grip portion. A wire contact is attached to each slide. A first and second row of terminals is molded in the housing. The first and second row of terminals rest above the bottom of the housing and are spaced apart to define a slot between the rows of terminals. The wire contacts are located between the terminals and the slide. The wire contacts operate, as the slide is moved, to make and break electrical connections between the terminals. The wire contact has an integrally formed pair of upright portions and a wire detent. The terminal has a detent cavity. The upright portion fits into and is retained by the slide groove. The wire detent, the detent cavity and the slot provide a positive mechanical stop for each of the switch positions.

10 Claims, 3 Drawing Sheets

DIP SWITCH WITH WIRE CONTACTS

BACKGROUND OF THE PREFERRED EMBODIMENT(S)

1. Field of the Preferred Embodiment(s)

This invention generally relates to a dual in line package (DIP) switches used on printed circuit boards for selecting between several switch positions. Specifically, there is a housing that contains a slide, wire contacts, terminals and a detent. As the slide is moved linearly, the wire contacts make and break electrical connections.

2. Description of the Related Art

Various devices are well known for selecting between several switch positions such as rotary switches, encoders, push button switches, linearly actuated switches, and prior art DIP switches.

It is desirable to provide a detent mechanism during operation of the switch in order to provide the user with a feedback as to the switch position. The prior art devices have typically had complex detent mechanisms that have added parts and additional assembly cost to the devices during manufacturing.

Despite the prior art devices, none have been easily manufacturable with a low part count at a low cost. A current unmet need exists for a DIP switch that has a low part count and that is easily assembled at a low cost.

DESCRIPTION OF RELATED ART

Examples of patents related to the present invention are as follows, wherein each patent is herein incorporated by reference for related and supporting teachings:

U.S. Pat. No. 4,268,728, is a switch encoder.

U.S. Pat. No. 4,324,958, is a tactile switch device.

U.S. Pat. No. 3,555,213, is a cross bar slide selector switch.

U.S. Pat. No. 4,389,549, is a side actuated miniature dip switch.

U.S. Pat. No. 4,529,851 is a machine insertable miniature dip switch.

European patent no. 0 003 434 A1 is an electrical switch.

The foregoing patents reflect the state of the art of which the applicant is aware and are tendered with the view toward discharging applicants' acknowledged duty of candor in disclosing information that may be pertinent in the examination of this application. It is respectfully stipulated, however, that none of these patents teach or render obvious, singly or when considered in combination, applicants' claimed invention.

SUMMARY OF THE PREFERRED EMBODIMENT(S)

It is a feature of the invention to provide a dual in line switch apparatus for selecting a plurality of switch positions, including a housing and a slide located within the housing. A row of wire contacts is attached to the slide. A row of terminals is attached to the housing so that the wire contacts are located between the terminals and the slide. The wire contacts operate, as the slide is moved, to make and break electrical connections between the terminals. The wire contact has an upright and a wire detent and the terminal has a detent cavity. The terminals are spaced so as to define a slot therebetween. The wire detent, the detent cavity and the slot are operable to provide a positive mechanical stop for each of the switch positions.

It is a feature of the invention to provide a switch apparatus for selecting a plurality of switch positions, including a housing and a slide located within the housing and having a pair of slide grooves. A row of wire contacts is attached to the slide and has a pair of uprights disposed in the slide grooves and a wire detent portion. A row of terminals is attached to the housing and has a detent cavity. The wire detent and the detent cavity are operable to provide a positive mechanical stop for a switch position. The wire contacts are located between the terminals and the slide such that as the slide is moved, electrical connections between the wire contacts and the terminals are made and broken. The terminals are spaced so as to define a slot therebetween. The wire detent and the slot provide a positive mechanical stop for a switch position.

A further feature of the invention is to provide a slide switch for allowing a user to select between a first and second switch position, including a housing and a first and second terminal attached to the housing. An actuator mechanism is located in the housing and has a wire contact attached thereto, for moving the wire contact between the first and second terminals which correspond to the first and second switch positions, respectively. A detent mechanism is attached to the actuator mechanism and to the first and second terminals, for providing a positive mechanical stop for the first and second switch positions. The actuator mechanism is a slide having a pair of slide grooves with the wire contact located therein. The detent mechanism is a wire detent connected to the wire contact and a detent cavity located in the first terminal. The detent mechanism also includes a slot located between the first and second terminal. The wire detent operates to move into the detent cavity and the slot as the actuator is moved to provide a positive mechanical stop for the first and second switch positions.

The invention resides not in any one of these features per se, but rather in the particular combination of all of them herein disclosed and claimed. Those skilled in the art will appreciate that the conception, upon which this disclosure is based, may readily be utilized as a basis for the designing of other structures, methods and systems for carrying out the several purposes of the present invention. Further, the abstract is neither intended to define the invention of the application, which is measured by the claims, neither is it intended to be limiting as to the scope of the invention in any way.

BRIEF DESCRIPTION OF THE DRAWINGS

These and other features of the invention can best be understood by the following description of the accompanying drawings as follows.

It is noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the accompanying drawings.

DETAILED DESCRIPTION OF THE PREFERRED EMBODIMENT

Figure 1:
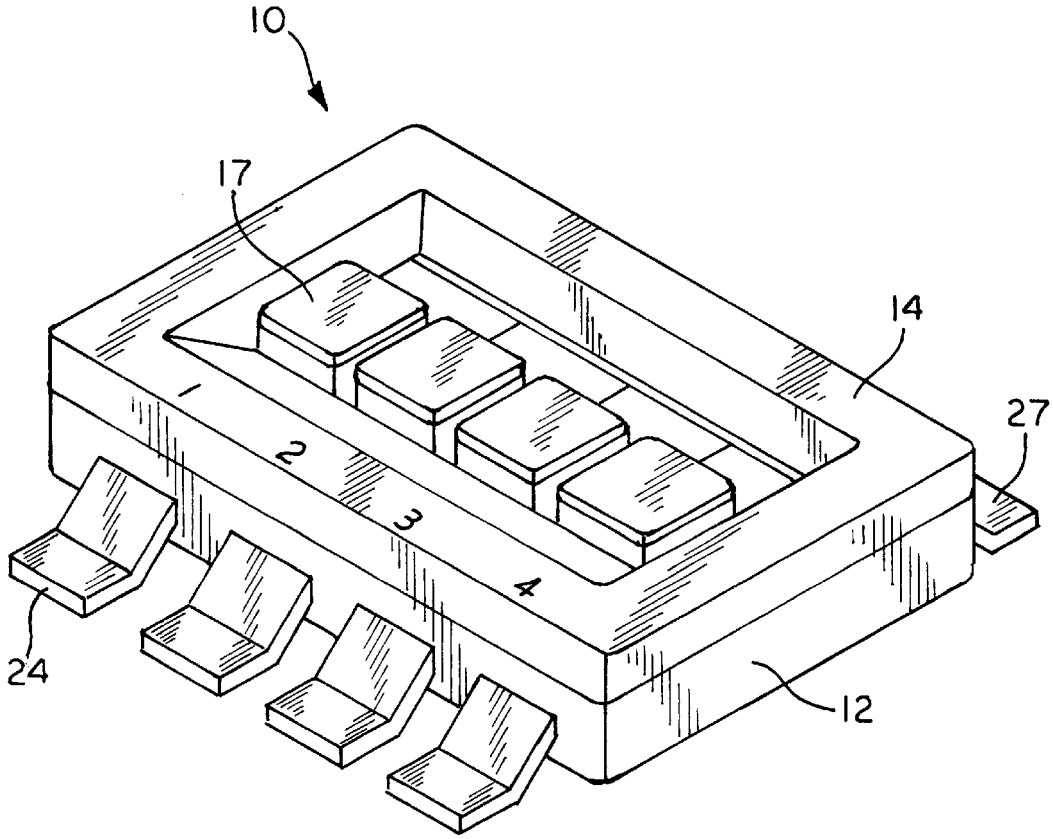
FIG. 1 is an perspective view of the preferred embodiment of a DIP switch with wire contacts.
Figure 2:
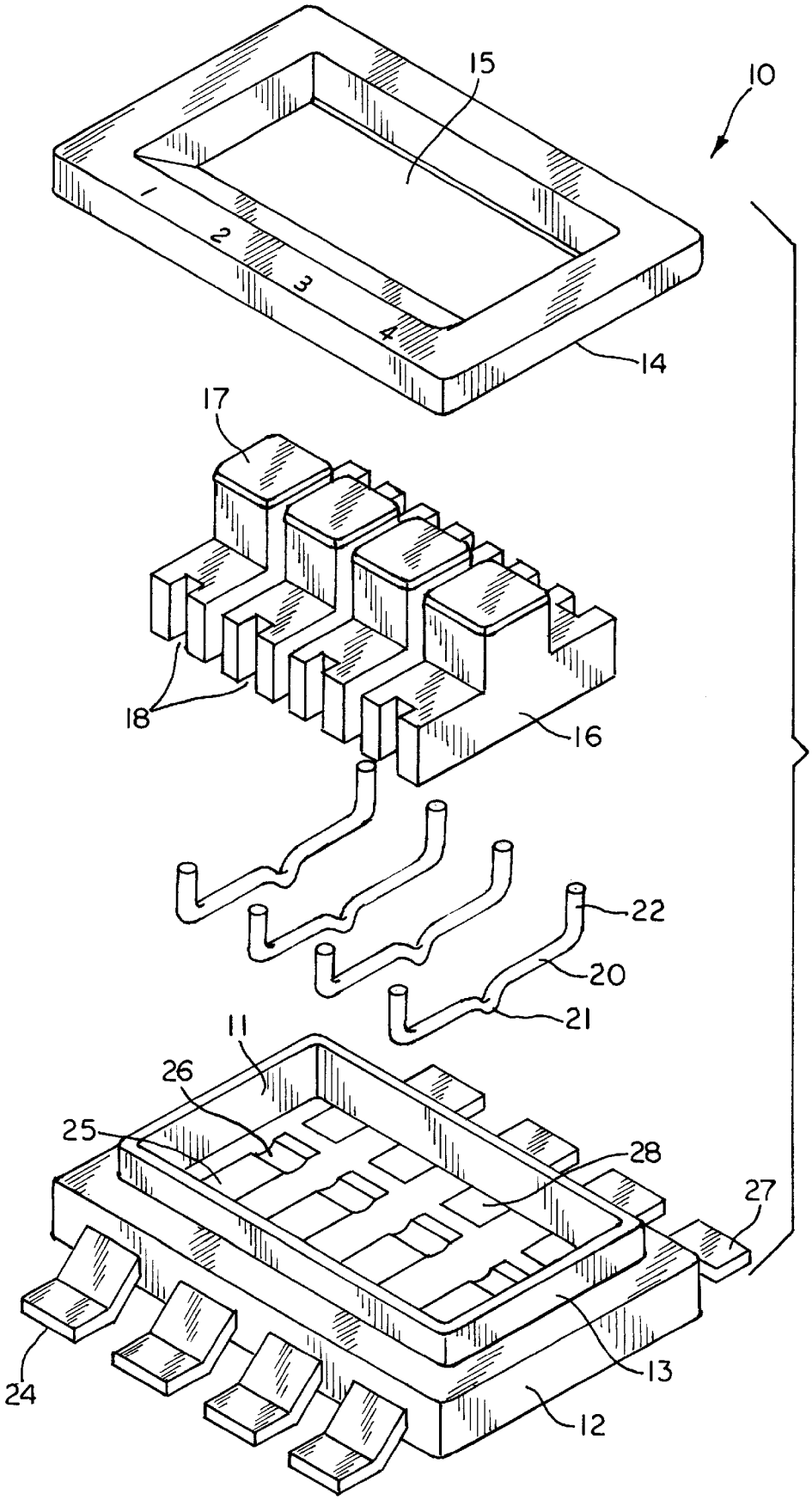
FIG. 2 is an exploded perspective view of FIG. 1.
Figure 3:
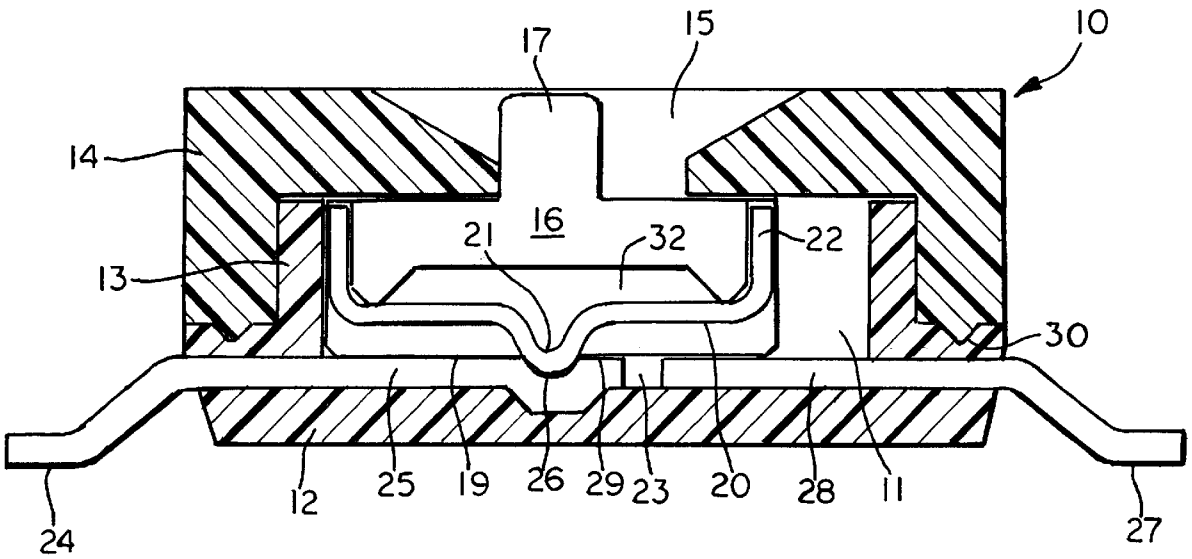
FIG. 3 is a cross-sectional view of FIG. 1 taken through one of the slides.

Referring to FIGS. 1, 2 and 3 there is shown a DIP switch assembly 10. Specifically, there is a generally rectangular housing 12 for containing switch assembly 10. Housing 12 has a cavity 11 therein and an upright wall 13. A cover 14 is designed to fit over wall 13 and abut against housing 12. Cover 14 has a cover aperture 15. Cover 14 may be joined to housing 12 by an ultrasonic weld 30. A T-shaped slide 16 has a slide grip 17 formed on the top, a pair of slide grooves 18 formed on two end sides and a slide bottom 19. A slide cavity 32 extends between slide grooves 18. A cylindrical rod shaped wire contact 20 has a pair of wire upright sections 22 and an U-shaped wire detent 21. Wire uprights 22 snugly fit into and are held by slide grooves 18. After wire contact 20 has been placed into slide 16, wire detent 21 extends below slide bottom 19. Housing 12, cover 14 and slide 16 are preferably molded out of plastic. Wire contacts 20 are formed by bending a rod of an alloy of copper. Insert molded into housing 12 is a terminal 28 and a detent terminal 25. Detent terminal 25 has an U-shaped detent cavity 26 and a detent terminal leg 24 that is downwardly bent and extends outside of and away from housing 12. Detent terminal 25 has a detent terminal tip 29. A slot 23 is formed between terminals 25 and 28. Terminal 28 has a terminal leg 27 that is downwardly bent and extends outside of and away from housing 12. Detent terminal leg 24 and terminal leg 27 may be typically soldered to a printed circuit board (not shown) to provide electrical connections between external circuits on the printed circuit board and the DIP switch. Detent terminal leg 24 and terminal leg 27 are formed from a rectangular strip of an alloy of copper.

Figure 4:
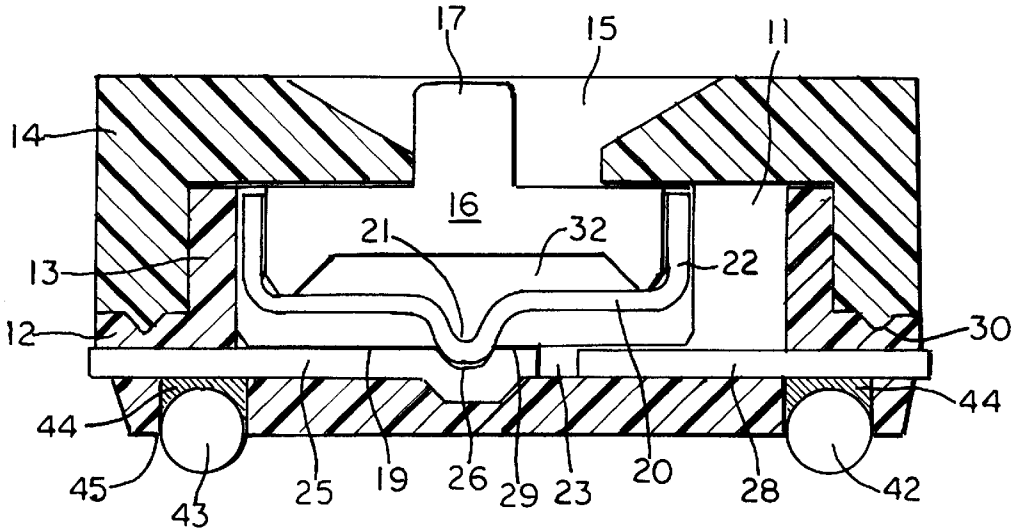
FIG. 4 is a cross-sectional view of an alternative embodiment using a solder sphere termination.

Referring to FIG. 4, there is shown an alternative embodiment of a DIP switch assembly 40. DIP switch 40 is identical to DIP switch 10 except that terminal leg 27 and detent leg 24 have been truncated and a detent terminal solder sphere or ball 43 and a terminal solder sphere or ball 42 has been added to connect with a printed circuit board (not shown). Housing 12 has been modified to add holes 45. Solder spheres 42 and 43 are located partially in holes 45. A solder paste 44 is used to connect solder spheres 42 and 43 to terminals 25 and 28.

The DIP switch assembly 10 is assembled as follows: The first step is to insert mold terminals 25 and 28 into housing 12. The second step is to press fit wire contacts 20 to slide 16 by inserting wire uprights 22 into slide grooves 18. The third step is to place the slide 16 and wire contacts 20 into cavity 11. The fourth step is to place cover 14 over housing 12 and to connected them with an ultrasonic weld 30.

During operation of DIP switch 10, slide grip 17 is grasped by the user and moved. As slide grip 17 moves, slide 16, wire contact 20 and wire detent 21 move. When wire detent 21 is initially engaged with detent cavity 26, the switch is in the off position and there is no electrical connection between terminals 25 and 28. As slide 16 is moved, wire detent 21 slides over detent terminal tip 29 and snaps or drops into slot 23. In this position, wire contact 20 completes an electrical connection between terminals 25 and 28 and the switch is in the on position.

Remarks About the Preferred Embodiment

One of ordinary skill in the arts of switches, and more particularly the art of designing DIP switches, will realize many advantages from using the preferred embodiment. In particular, the DIP switch provides the user with a positive mechanical feedback when the switch is in both the on and off positions. Specifically, note that when slide 16 is moved, wire detent 31 snaps into and out of slot 23 and detent cavity 26. Slot 23 and cavity 26 provide a tactile mechanical feedback to the user as to the position of the DIP switch.

Additionally, a skilled artisan will understand that the DIP switch can be fabricated in a small size and has a small footprint when it is mounted on a printed circuit board. Specifically, the use of wire contact 20 allows for a very narrow slide and when several slides are stacked side by side results in the overall size of the DIP switch being small. Also, DIP switch 10 does not have spacers or guides between the slides as is shown in the prior art. The omission of the spacers contributes to achieving a narrower design and a fine pitch. It is further noted that a skilled artisan would realize that the DIP switch 10 is capable of being economically manufactured. Specifically, the use of wire contacts 20 being press-fit into slide 16 and insert molding housing 12 with terminals 25 and 28 is very cost effective and results in an easily assembled switch.

Variations of the Preferred Embodiment(s)

One of ordinary skill in the art of making switches will realize that there are many different ways of accomplishing the preferred embodiment. For example, it is contemplated to make the housing 12, cover 14, and slide 16 out of any suitable material, like plastics, epoxy resin, or fiberglass. Additionally, the cover could be fastened to the housing by other methods such as glue or screws, or mechanical fasteners.

Even though, the embodiment discusses the use of two terminals 25 and 28, it is contemplated to use three or four or more terminals in a row to provide multiple switch positions. Two or more detent positions could be used with the multiple switch positions for each slide.

Although, switch 10 is illustrated as having a wire detent 21, it is contemplated to omit wire detent 21 and provide no mechanical feedback to the user.

Additionally, although it is illustrated that wire contacts 20 have a generally circular shape, it is contemplated to form the wire contacts from a variety of shapes such as square, oval, or rectangular metal strip. Although it is illustrated that terminals 25 and 28 have a generally rectangular shape, it is contemplated to form terminals 25 and 28 from a variety of shapes such as square, oval, or circular metal strip.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by Letters Patent is:

1. A surface mount dual in line switch apparatus for selecting a plurality of switch positions, comprising:

a) a housing having a cavity;

b) a slide disposed within the cavity, the slide including:

1) a pair of slide grooves;

2) a slide grip portion;

c) a cover, attached to the housing, the cover having an aperture, the slide grip portion extending through the aperture;

d) a wire contact attached to the slide, the wire contact including:

1) a pair of upright sections that fit into and are contained by the slide grooves;

2) a wire detent;

e) a first and second row of terminals, attached to the housing and disposed above a bottom of the housing, so that the wire contact is located between the terminals and the slide, the wire contact operable, as the slide is moved, to make and break electrical connections between the terminals, the terminals having a leg portion extending outside of the housing for making a surface mount connection to a printed circuit board;

f) a detent cavity located in each first row terminal; and g) a slot defined between the first and second row of terminals, the detent cavity and the slot operable to provide a positive mechanical stop with tactile feedback for each of the switch positions.

2. The apparatus according to claim 1, wherein the housing is a one piece molded housing having the terminals molded therein.

3. A dual in line switch apparatus for selecting a plurality of switch positions, comprising:

a) a housing having a cavity;

b) a slide disposed within the cavity, the slide including:
1) a pair of slide grooves;
2) a slide grip portion;

c) a cover, attached to the housing, the cover having an aperture, the slide grip portion extending through the aperture;

d) a wire contact attached to the slide, the wire contact including:
1) a pair of upright sections that fit into and are contained by the slide grooves;
2) a wire detent;

e) a first and second row of terminals, attached to the housing and disposed above a bottom of the housing, so that the wire contact is located between the terminals and the slide, the wire contact operable, as the slide is moved, to make and break electrical connections between the terminals;

f) a plurality of solder spheres attached to the terminals, the solder spheres connectable to a printed circuit board, the solder spheres partially disposed within the housing;

g) a detent cavity located in each first row terminal; and h) a slot defined between the first and second row of terminals, the detent cavity and the slot operable to provide a positive mechanical stop with tactile feedback for each of the switch positions.

4. The apparatus according to claim 3, wherein the housing is a one piece molded housing having the terminals molded therein.

5. The apparatus according to claim 3, wherein the solder spheres are attached to the terminals by a reflowed solder paste.

6. A dual in line switch apparatus for selecting a plurality of switch positions, comprising:

a) a housing having a cavity;

b) a slide disposed within the cavity, the slide including:
1) a pair of slide grooves;
2) a slide grip portion;

c) a cover, attached to the housing, the cover having an aperture, the slide grip portion extending through the aperture;

d) a wire contact attached to the slide, the wire contact including:
1) a pair of upright sections that fit into and are contained by the slide grooves;
2) a wire detent;

e) a first and second row of terminals, attached to the housing, and disposed above a bottom of the housing, so that the wire contact is located between the terminals and the slide, the wire contact operable, as the slide is moved, to make and break electrical connections between the terminals;

f) first detent means, attached to the first row of terminals, for providing a positive mechanical stop for the first switch position; and g) second detent means, defined between the first and second row of terminals, for providing a positive mechanical stop for the second switch position.

7. The apparatus according to claim 6, wherein the first detent means is a wire detent attached to the wire contact.

8. The apparatus according to claim 6, wherein the second detent means is a slot defined between the first and second row of terminals.

9. The apparatus according to claim 6, wherein a plurality of solder spheres are attached to the terminals, the solder spheres connectable to a printed circuit board, the solder spheres partially disposed within the housing.

10. The apparatus according to claim 9, wherein the solder spheres are attached to the terminals by a reflowed solder paste.

* * * * *